US006172345B1

(12) United States Patent
Dial et al.

(10) Patent No.: US 6,172,345 B1
(45) Date of Patent: Jan. 9, 2001

(54) HIGH-VOLTAGE CARTRIDGE HEATER AND METHOD OF MANUFACTURING SAME

(75) Inventors: Gary L. Dial; Sidney L. Furlong; Amy M. Barker, all of Ogden, UT (US)

(73) Assignee: Emerson Electric Co., St. Louis, MO (US)

( * ) Notice: Under 35 U.S.C. 154(b), the term of this patent shall be extended for 0 days.

(21) Appl. No.: 09/412,666

(22) Filed: Oct. 5, 1999

Related U.S. Application Data

(60) Provisional application No. 60/156,164, filed on Sep. 27, 1999.

(51) Int. Cl.[7] ..... H05B 3/44

(52) U.S. Cl. ..... 219/544; 219/546; 338/238

(58) Field of Search ..... 219/544, 523, 219/534, 535, 541, 543, 548, 553; 392/503; 338/230, 238, 241, 243, 246, 251, 264, 270, 274, 321

(56) References Cited

U.S. PATENT DOCUMENTS 3,839,623 * 10/1974 Portmann ..... 219/541
4,115,686 * 9/1978 Williams et al. ..... 219/523
4,150,281 * 4/1979 Hinz ..... 219/535
4,238,671 * 12/1980 Gellert ..... 219/544
4,424,439 * 1/1984 Payne et al. ..... 219/544
5,066,852 * 11/1991 Willbanks ..... 219/544
5,095,193 * 3/1992 Doyle ..... 219/544
5,380,987 * 1/1995 Morici ..... 219/544
5,875,283 * 2/1999 Yane et al. ..... 219/544

* cited by examiner

*Primary Examiner*—Teresa Walberg
*Assistant Examiner*—Fadi H. Dahbour
(74) *Attorney, Agent, or Firm*—Howrey Simon Arnold & White, LLP

(57) ABSTRACT

A cartridge heater for high-voltage applications is disclosed. In one embodiment, the cartridge heater is substantially elongate and cylindrical, and comprises an outer stainless steel sheath having an outside diameter on the order of one-half inch or less. Within the outer sheath is a resistive heating element coiled around an inner, electrically insulating wind core. A substantially hollow cylindrical core sleeve is disposed around the heating element and wind core, electrically insulating the heating element from the outer sheath. In one embodiment, the core sleeve is composed of pre-compressed magnesium oxide.

9 Claims, 1 Drawing Sheet

HIGH-VOLTAGE CARTRIDGE HEATER AND METHOD OF MANUFACTURING SAME

RELATED APPLICATION

Pursuant to 35 U.S.C. § 119, this application claims the priority of prior provisional U.S. patent application Ser. No. 60/156,164 filed on Sep. 27, 1999, which application being hereby incorporated by reference herein in its entirety.

FIELD OF THE INVENTION

This invention relates generally to the field of electric heaters, and more particularly to a cartridge-type electric heater and a method of manufacturing same.

BACKGROUND OF THE INVENTION

Various configurations of cartridge heaters are known in the prior art. A typical cartridge heater comprises a resistance wire heating element coiled around an elongate core of insulating material, and an elongate metal sheath that is coaxial with the coiled heating element and core and radially spaced from the coil. An insulating material having an optimum combination of relatively high thermal conductivity and relatively low electrical conductivity is used to fill the space between the coil and the sheath. Granulated magnesium oxide is one substance known to be suitable for the purposes of serving as the insulating filler material. Toward the end of the manufacturing process, the granulated magnesium oxide is introduced into the sheath, for example by gravity feed. Upon sealing the sheath, the sheath is subjected to compression forces, for example, by swaging, thereby compacting the granulated magnesium oxide to improve its dielectric and thermal conductive properties.

Depending upon the intended application, cartridge heaters of varying sizes and voltage ratings may be required. In many applications, a relatively high voltage, on the order of 480 volts or so, may be desired.

With current manufacturing technology, it has proven to be a challenge to reliably produce high-voltage cartridge heaters whose sheaths have an outside diameter of one-half inch or less. Typically, such a combination of factors (small diameter, high voltage) tends to lead to problems with dieletric breakdown and current leakage problems. In some cases, operating parameters such as dielectric strength and current leakage must be kept within predetermined limits in order for the cartridge to meet certain industry standards, such as those standards established by Underwriters' Laboratories (for example, the UL 499 and UL 544 standards).

One apparent reason for such problems is that for smaller cartridges, tight manufacturing tolerances cannot be repeatably maintained with current cartridge filling equipment and manufacturing procedures. An element core which is as little as 0.001 inch off-center after filling can compromise the dielectric strength of the element. Thickness, compaction, and therefore density of the filler material may be inadequate for reliable dielectric strength at the operating temperatures of the heater.

As a result of these considerations, high-voltage cartridge heaters are traditionally only offered in diameters larger than one-half inch, or employ designs which do not qualify for certification under the applicable industry standards.

SUMMARY OF THE INVENTION

In view of the foregoing considerations, the present invention is directed in one respect to a high-voltage cartridge heater designed so as to enable the cartridge to have a relatively small diameter while at the same time be repeatably manufacturable to desired standards.

In accordance with one aspect of the invention, a high-voltage cartridge heater is provided with a core sleeve composed of a pre-compacted insulating material. The core sleeve is disposed around the coiled heating element within the outer sheath of the heater. The sleeve assures the thickness and density of the insulating material remains consistent and constitutes a reliable and repeatable method of insulating high-voltage heating elements. The core sleeve further assures that consistent manufacturing tolerances are met, since critical tolerances from coil to sheath are manufactured into the core itself.

In one embodiment, the core sleeve is composed of pre-compacted magnesium oxide having an generally annular, elongate configuration. In another embodiment, a core sleeve composed of mica is used.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION OF A SPECIFIC EMBODIMENT OF THE INVENTION

Figure 1:
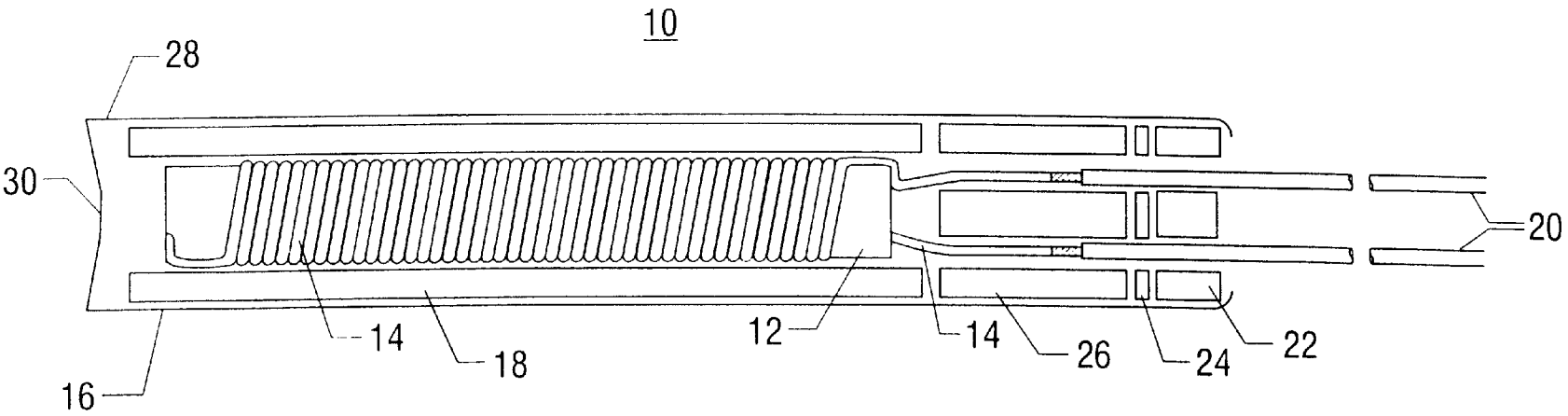
FIG. 1 is a cross-sectional side view of a cartridge heater in accordance with one embodiment of the invention.

In the disclosure that follows, in the interest of clarity, not all features of actual implementations are described. It will of course be appreciated that in the development of any such actual implementation, as in any such project, numerous engineering and design decisions must be made to achieve the developers' specific goals and subgoals (e.g., compliance with system-and business-related constraints), which will vary from one implementation to another. Moreover, attention will necessarily be paid to proper engineering and design practices for the environment in question. It will be appreciated that such a development effort might be complex and time-consuming, but would nevertheless be a routine undertaking for those of ordinary skill in the field of electric heaters.

Referring to FIG. 1, there is shown a side cross-sectional view of a cartridge heater 10 in accordance with one embodiment of the invention. In the embodiment of FIG. 1, heater 10 comprises an elongate heater element wind core 12 about which a resistive heating element wire 14 is coiled, in an essentially conventional configuration. In the presently disclosed embodiment, wind core 12 is made of magnesium oxide, and is substantially cylindrical.

Wind core 12 and coiled wire 14 are disposed within an outer sheath 16 made of, for example, stainless steel or the like. In accordance with a notable aspect of the present invention, interposed between the inner diameter of sheath 16 and heating element 14 is an electrically insulating, thermally conducting core sleeve 18. In the presently disclosed embodiment, core sleeve 18 is composed of pre-compacted magnesium oxide and has a substantially hollow cylindrical configuration so as to receive wind core 12 and coiled heating element 14 therein. Advantageously, magnesium oxide core sleeve 18 can withstand higher core operating temperatures compared to other substances, such as mica. Further, the pre-compressed configuration of core sleeve 18 endows it with higher dielectric strength as compared to loose-fill prior art insulating configurations.

With continued reference to FIG. 1, operating power is supplied to cartridge heater 10 by means of two supply wires 20. In the presently disclosed embodiment, wires 20 are preferably 18-gauge, Teflon™-coated wire rated to conduct on the order of 600 volts. Wires 20 enter the proximal end of heater 10 through a Teflon™ end plug 22 and a mica disk 24 each having appropriately sized through-holes formed therein. Wires 20 then pass into a dummy core 26 of insulating material, such that at least a portion of the Teflon™ coating of wires 20 extends into dummy core 26. Within dummy core 26, electrical contact is made between wires 20 and coiled heating element wire 14. As shown in FIG. 1, a small gap is preferably maintained between dummy core 26 and wind core 12.

In one embodiment, end plug 22 is adapted to be engaged permanently in the distal end of sheath 16, as depicted in FIG. 1. Those of ordinary skill in the art will appreciate that there are potential applications for cartridge heater 10 in which the distal end of sheath 16 may be exposed to temperatures exceeding those that end plug 22 may be capable of withstanding. Accordingly, in another embodiment of the invention, end plug 22 is adapted to be removable from sheath 16 once heater 10 has been assembled and swaged (as will be hereinafter described in further detail). In such an embodiment, the void left within sheath 16 upon removal of end plug 22 may then be filled with a suitable enclosure material, for example, an epoxy, a curable silicon, or a ceramic paste, depending upon the intended application for heater 10.

In the presently disclosed embodiment, sheath 16 is approximately three and one-half inches long, preferably has an outer diameter of one-half inch or less; the relatively small size of sheath 16 is advantageously achieved as a result of the provision of pre-compacted core sleeve 18. In conventional designs, i.e., ones not employing a core sleeve as disclosed herein, the space between core 12 and sheath 16 is filled with a granular material, such as granular magnesium oxide. Core sleeve 12 in the presently disclosed embodiment has a length of approximately two and three-fourths inches; dummy core has a length of one-half inch or less. The aforementioned gap between dummy core 26 and wind core 12 is preferably on the order of 1/8 to 1/16 of an inch.

Regarding the manufacturing process, cartridge heater 10 is assembled as follows: Initially, the various components of heater 10 are inserted into sheath 16 from its distal end, designated with reference numeral 28. In one embodiment, core sleeve 18 is fabricated beginning with a substantially cylindrical "blank" of pre-compacted magnesium oxide through which a central axial bore is made. Those of ordinary skill in the art will appreciate that the process of boring through the magnesium oxide bore is preferably accomplished using a diamond-tipped bit. In an alternative embodiment, core sleeve 18 may be fabricated using an extrusion process beginning with the magnesium oxide in a paste-like state capable of passing through an extruder to achieve the hollow cylindrical configuration. In this case, core sleeve would preferably be subjected to firing in a furnace in order to harden it and achieve the desired electrical and thermal properties.

Once all of the components are assembled within sheath 16, additional granular magnesium oxide is preferably introduced into distal end 28 of sheath 16, in order to fill all remaining voids therein to the extent possible. Shaking or vibration of the assembly may be desirable at this stage in order to ensure maximum filling. Next, an end cap 30 is welded over the distal end 28. Finally, the entire assembly is swaged to compress and reduce the overall diameter of sheath 16. This swaging process more fully compacts the internal magnesium oxide elements, thereby enhancing the dielectric and thermal conductive properties of heater 10. Those of ordinary skill in the art will be familiar with various techniques and tools suitable for performing the swaging operation as described herein.

From the foregoing detailed description of a specific embodiment of the invention, it should be apparent that a cartridge heater for high-voltage applications has been disclosed. Although a specific embodiment of the invention has been disclosed herein in some detail, this has been done solely for the purposes of illustrating various aspects and features of the invention, and is not intended to be limiting with respect to the scope of the invention. It is contemplated that various substitutions, alterations, and/or modifications, including but not limited to those design alternatives which might have been specifically noted in this disclosure, may be made to the disclosed embodiment without departing from the spirit and scope of the invention as defined in the appended claims.

Specifically, those of ordinary skill in the art having the benefit of the present disclosure will appreciate that the present invention may be advantageously practiced in connection with cartridge heaters of essentially any wattage, voltage, or current rating, and of essentially any size.

What is claimed is:

1. A cartridge heater, comprising:

a substantially elongate heater element comprising a resistive wire coiled about a wind core;

a substantially elongate hollow cylindrical outer sheath, coaxial with and disposed around said heater element;

a substantially elongate hollow pre-compacted cylindrical core sleeve adapted to have said heater element inserted therein, coaxial with and disposed between said outer sheath and said heater element.

2. A cartridge heater in accordance with claim 1, wherein said core sleeve is composed of an electrically insulating, thermally conducting material.

3. A cartridge heater in accordance with claim 2, wherein said core sleeve is composed of magnesium oxide.

4. A cartridge heater in accordance with claim 3, wherein said core sleeve is composed of pre-compacted magnesium oxide.

5. A method of manufacturing a cartridge heater, comprising:

(a) disposing a substantially elongate heater element comprising a resistive wire coiled about a wind core within and coaxial with a substantially elongate hollow cylindrical outer sheath;

(b) inserting said heater element into a substantially elongate hollow pre-compacted cylindrical core sleeve such that said pre-compacted cylindrical core sleeve is coaxial with and between said heater element and said sheath.

6. A method in accordance with claim 5, further comprising:

(c) introducing additional granular material into said sheath;

(d) capping said sheath; and (e) swaging said sheath to compress said granular material and said core sleeve.

7. A method in accordance with claim 6, wherein said core sleeve is composed an electrically insulating, thermally conducting material.

8. A method in accordance with claim 7, wherein said core sleeve is composed of magnesium oxide.

9. A method in accordance with claim 8, wherein said core sleeve is composed of pre-compacted magnesium oxide.

* * * * *